US007700539B2

(12) United States Patent
Muller et al.

(10) Patent No.: US 7,700,539 B2
(45) Date of Patent: Apr. 20, 2010

(54) PARTICULATE LAUNDRY DETERGENT COMPOSITION COMPRISING A DETERSIVE SURFACTANT, CARBONATE AND A CELLULOSIC POLYMER

(75) Inventors: John Peter Eric Muller, Newcastle-upon-Tyne (GB); Alan Thomas Brooker, Newcastle-upon-Tyne (GB); Doris Appleby, Newcastle-upon-Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 742 days.

(21) Appl. No.: 11/358,558

(22) Filed: Feb. 21, 2006

(65) Prior Publication Data

US 2006/0189506 A1 Aug. 24, 2006

(30) Foreign Application Priority Data

Feb. 21, 2005 (EP) ..... 05250962

(51) Int. Cl.
*C11D 17/06* (2006.01)
*C11D 3/60* (2006.01)

(52) U.S. Cl. ..... 510/276; 510/350; 510/351; 510/438; 510/473; 510/504; 510/509

(58) Field of Classification Search ..... 510/276, 510/438, 473, 509, 350, 351, 504
See application file for complete search history.

(56) References Cited

U.S. PATENT DOCUMENTS

| | | | | |
|---|---|---|---|---|
| 3,886,098 | A | 5/1975 | DiSalvo et al. | |
| 4,487,710 | A | 12/1984 | Kaminsky | |
| 5,108,646 | A * | 4/1992 | Beerse et al. | 510/532 |
| 5,663,136 | A | 9/1997 | Van Dijk et al. | |
| 5,869,438 | A | 2/1999 | Svendsen et al. | |
| 5,942,483 | A | 8/1999 | Leu et al. | |
| 6,080,711 | A | 6/2000 | Brouwer et al. | |
| 6,232,285 | B1 | 5/2001 | Casteel et al. | |
| 6,369,020 | B1 * | 4/2002 | Kohlus et al. | 510/438 |
| 7,078,373 | B2 * | 7/2006 | Burrows et al. | 510/351 |
| 2005/0187127 | A1 * | 8/2005 | Somerville Roberts et al. | 510/336 |
| 2006/0035802 | A1 * | 2/2006 | Brooker et al. | 510/445 |
| 2006/0189501 | A1 | 8/2006 | Lant et al. | |
| 2006/0189505 | A1 | 8/2006 | Muller et al. | |
| 2007/0037726 | A1 * | 2/2007 | Brooker et al. | 510/476 |

FOREIGN PATENT DOCUMENTS

| | | |
|---|---|---|
| GB | 1408969 | 10/1975 |
| GB | 1408970 | 10/1975 |
| WO | WO 99/36493 A1 | 7/1999 |
| WO | WO 00/60063 A1 | 10/2000 |
| WO | WO 02/077141 A1 | 10/2002 |
| WO | WO 2004/041982 A1 | 5/2004 |

OTHER PUBLICATIONS

U.S. Appl. No. 11/358,562, filed Feb. 21, 2006, Lant et al.
U.S. Appl. No. 11/368,337, filed Mar. 3, 2006, Lant.
PCT International Search Report, date of mailing - May 31, 2006 - 12 pages (PCT/IB2006/050449).

* cited by examiner

*Primary Examiner*—Lorna M Douyon
(74) *Attorney, Agent, or Firm*—Gary J. Foose; David V. Upite; Ronald Terk Sia

(57) ABSTRACT

The present invention relates to a solid free-flowing particulate laundry detergent composition comprising a detersive surfactant, carbonate and a cellulosic polymer.

13 Claims, No Drawings

PARTICULATE LAUNDRY DETERGENT COMPOSITION COMPRISING A DETERSIVE SURFACTANT, CARBONATE AND A CELLULOSIC POLYMER

FIELD OF THE INVENTION

The present invention relates to a highly water-soluble solid laundry detergent composition. More specifically, the present invention relates to a solid laundry detergent composition comprising a detersive surfactant system, carbonate, a cellulosic polymer and low or no levels of zeolite builder and phosphate builder.

BACKGROUND OF THE INVENTION

Laundry detergent compositions need to have a very good fabric-cleaning performance against a wide variety of soil types. Solid laundry detergents also need to have very good dispensing and dissolution profiles. However, a dichotomy may exist in that some reformulations of the solid laundry detergent composition to improve its fabric-cleaning performance may negatively impact its dispensing and dissolution profiles, and vice versa. It is very difficult to improve the cleaning performance, dispensing profile and dissolution profile of a solid laundry detergent composition at the same time. Furthermore, it is also desirable for highly water-soluble solid laundry detergent compositions to form a clear wash liquor upon dissolution in water. This is because having a clear wash liquor is a desired consumer signal that the solid laundry detergent composition has dissolved.

Anionic detersive surfactants are incorporated into granular laundry detergent compositions in order to provide a good fabric-cleaning benefit. For example, GB1408969, GB1408970, U.S. Pat. No. 4,487,710, U.S. Pat. No. 5,663,136 and WO2004/041982 all relate to compositions comprising anionic detersive surfactants. However, the anionic detersive surfactant is capable of complexing with free cations, such as calcium and magnesium cations, that are present in the wash liquor in such a manner as to cause the anionic detersive surfactant to precipitate out of solution, which leads to a reduction in the anionic detersive surfactant activity. In extreme cases, these water-insoluble complexes may deposit onto the fabric resulting in poor whiteness maintenance and poor fabric integrity benefits. This is especially problematic when the laundry detergent composition is used in hard-water washing conditions when there is a high concentration of calcium cations.

The anionic detersive surfactant's tendency to complex with free cations in the wash liquor in such a manner as to precipitate out of solution is mitigated by the presence of builders, such as zeolite builders and phosphate builders, which have a high binding constant with cations such as calcium and magnesium cations. These builders sequester free calcium and magnesium cations and reduce the formation of these undesirable complexes. However, zeolite builders are water-insoluble and their incorporation in laundry detergent compositions leads to poor dissolution of the laundry detergent composition and can also lead to undesirable residues being deposited on the fabric. In addition, detergent compositions that comprise high levels of zeolite builder form undesirable cloudy wash liquors upon contact with water. Whilst phosphate builders allegedly do not have favourable environmental profiles and their use in laundry detergent compositions is becoming less common; for example, due to phosphate legislation in many countries.

Detergent compositions comprising alkyl benzene sulphonate and alkyl ethoxylated sulphate detersive surfactants are described in GB1408969, GB1408970, U.S. Pat. No. 4,487,710 and U.S. Pat. No. 5,663,136. A detergent composition comprising an anionic detersive surfactant and a non-ionic detersive surfactant that allegedly gives enhanced stain removal at a wide range of water-hardness is described in WO2004/041982.

There remains a need for a solid free flowing particulate laundry detergent composition comprising a detersive surfactant having a good fabric-cleaning performance, especially a good greasy stain cleaning performance, good whiteness maintenance, and very good dispensing and dissolution profiles, and which upon dissolution in water gives a clear wash liquor.

SUMMARY OF THE INVENTION

The Inventors have found that there is a tendency for low zeolite builder and low phosphate builder containing laundry detergent particles that comprise carbonate and a cellulosic polymer to have poor particle appearance characteristics; in particular there is a tendency for these laundry detergent particles to have an undesirable yellowish hue. The Inventors have found that this problem can be overcome by controlling the levels and location of the carbonate and the cellulosic polymer in the free flowing particulate laundry detergent composition.

The present invention provides a solid laundry detergent composition comprising: (a) a detersive surfactant; (b) from 0 wt % to 10 wt % zeolite builder; (c) from 0 wt % to 10 wt % phosphate builder; (d) carbonate; and (e) a cellulosic polymer; wherein the composition is in free-flowing particulate form and comprises at least two separate particulate components, wherein the first particulate component comprises: (i) a detersive surfactant; (ii) at least 10 wt %, by weight of the first particulate component, of carbonate; (iii) from 0 wt % to 10 wt %, by weight of the first particulate component, of a zeolite builder; (iv) from 0 wt % to 10 wt %, by weight of the first particulate component, of a phosphate builder; and (v) from 0 wt % to less than 5 wt %, by weight of the first particulate component, of a cellullosic polymer; and wherein the second particulate component comprises: (i) at least 0.20 wt %, by weight of the second particulate component, of a cellulosic polymer; and (ii) from 0 wt % to less than 20 wt %, by weight of the second particulate component, of carbonate.

DETAILED DESCRIPTION OF THE INVENTION

Detersive surfactant

The composition comprises a detersive surfactant. Suitable detersive surfactants include anionic detersive surfactants, nonionic detersive surfactants, cationic detersive surfactants, zwitterionic detersive surfactants, amphoteric detersive surfactants and mixtures thereof.

Suitable anionic detersive surfactants include: alkyl sulphates; alkyl sulphonates; alkyl phosphates; alkyl phosphonates; alkyl carboxylates; and mixtures thereof. The anionic surfactant can be selected from the group consisting of: $C_{10}$-$C_{18}$ alkyl benzene sulphonates (LAS) preferably $C_{10}$-$C_{13}$ alkyl benzene sulphonates; $C_{10}$-$C_{20}$ primary, branched-chain, linear-chain and random-chain alkyl sulphates (AS), typically having the following formula:

$$CH_3(CH_2)_xCH_2—OSO_3^-M^+$$

wherein, M is hydrogen or a cation which provides charge neutrality, preferred cations are sodium and ammonium cations, wherein x is an integer of at least 7, preferably at least 9; $C_{10}$-$C_{18}$ secondary (2,3) alkyl sulphates, typically having the following formulae:

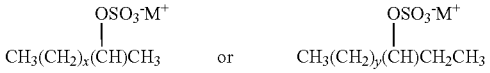

wherein, M is hydrogen or a cation which provides charge neutrality, preferred cations include sodium and ammonium cations, wherein x is an integer of at least 7, preferably at least 9, y is an integer of at least 8, preferably at least 9; $C_{10}$-$C_{18}$ alkyl alkoxy carboxylates; mid-chain branched alkyl sulphates as described in more detail in U.S. Pat. Nos. 6,020,303 and 6,060,443; modified alkylbenzene sulphonate (MLAS) as described in more detail in WO 99/05243, WO 99/05242, WO 99/05244, WO 99/05082, WO 99/05084, WO 99/05241, WO 99/07656, WO 00/23549, and WO 00/23548; methyl ester sulphonate (MES); alpha-olefin sulphonate (AOS) and mixtures thereof.

Preferred anionic detersive surfactants include: linear or branched, substituted or unsubstituted alkyl benzene sulphonate detersive surfactants, preferably linear $C_8$-$C_{18}$ alkyl benzene sulphonate detersive surfactants; linear or branched, substituted or unsubstituted alkyl benzene sulphate detersive surfactants; linear or branched, substituted or unsubstituted alkyl sulphate detersive surfactants, including linear $C_8$-$C_{18}$ alkyl sulphate detersive surfactants, $C_1$-$C_3$ alkyl branched $C_8$-$C_{18}$ alkyl sulphate detersive surfactants, linear or branched alkoxylated $C_8$-$C_{18}$ alkyl sulphate detersive surfactants and mixtures thereof; linear or branched, substituted or unsubstituted alkyl sulphonate detersive surfactants; and mixtures thereof.

Preferred alkoxylated alkyl sulphate detersive surfactants are linear or branched, substituted or unsubstituted $C_{8-18}$ alkyl alkoxylated sulphate detersive surfactants having an average degree of alkoxylation of from 1 to 30, preferably from 1 to 10. Preferably, the alkoxylated alkyl sulphate detersive surfactant is a linear or branched, substituted or unsubstituted $C_{8-18}$ alkyl ethoxylated sulphate having an average degree of ethoxylation of from 1 to 10. Most preferably, the alkoxylated alkyl sulphate detersive surfactant is a linear unsubstituted $C_{8-18}$ alkyl ethoxylated sulphate having an average degree of ethoxylation of from 3 to 7.

Preferred anionic detersive surfactants are selected from the group consisting of: linear or branched, substituted or unsubstituted, $C_{12-18}$ alkyl sulphates; linear or branched, substituted or unsubstituted, $C_{10-13}$ alkylbenzene sulphonates, preferably linear $C_{10-13}$ alkylbenzene sulphonates; and mixtures thereof. Highly preferred are linear $C_{10-13}$ alkylbenzene sulphonates. Highly preferred are linear $C_{10-13}$ alkylbenzene sulphonates that are obtainable, preferably obtained, by sulphonating commercially available linear alkyl benzenes (LAB); suitable LAB include low 2-phenyl LAB, such as those supplied by Sasol under the tradename Isochem® or those supplied by Petresa under the tradename Petrelab ®, other suitable LAB include high 2-phenyl LAB, such as those supplied by Sasol under the tradename Hyblene®.

Suitable cationic detersive surfactants include: alkyl pyridinium compounds; alkyl quaternary ammonium compounds; alkyl quaternary phosphonium compounds; alkyl ternary sulphonium compounds; and mixtures thereof. The cationic detersive surfactant can be selected from the group consisting of: alkoxylate quaternary ammonium (AQA) surfactants as described in more detail in U.S. Pat. No. 6,136,769; dimethyl hydroxyethyl quaternary ammonium as described in more detail in U.S. Pat. No. 6,004,922; polyamine cationic surfactants as described in more detail in WO 98/35002, WO 98/35003, WO 98/35004, WO 98/35005, and WO 98/35006; cationic ester surfactants as described in more detail in U.S. Pat. Nos. 4,228,042, 4,239,660, 4,260,529 and 6,022,844; amino surfactants as described in more detail in U.S. Pat. No. 6,221,825 and WO 00/47708, specifically amido propyldimethyl amine; and mixtures thereof. Preferred cationic detersive surfactants are quaternary ammonium compounds having the general formula:

$$(R)(R^1)(R^2)(R^3)N^+X^-$$

wherein, R is a linear or branched, substituted or unsubstituted $C_{6-18}$ alkyl or alkenyl moiety, $R^1$ and $R^2$ are independently selected from methyl or ethyl moieties, $R^3$ is a hydroxyl, hydroxymethyl or a hydroxyethyl moiety, X is an anion which provides charge neutrality, preferred anions include halides (such as chloride), sulphate and sulphonate. Preferred cationic detersive surfactants are mono-$C_{6-18}$ alkyl mono-hydroxyethyl di-methyl quaternary ammonium chlorides. Highly preferred cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Suitable non-ionic detersive surfactant can be selected from the group consisting of: $C_8$-$C_{18}$ alkyl ethoxylates, such as, NEODOL® non-ionic surfactants from Shell; $C_6$-$C_{12}$ alkyl phenol alkoxylates wherein the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, $BAE_X$, wherein x=from 1 to 30, as described in more detail in U.S. Pat. Nos. 6,153,577, 6,020,303 and 6,093,856; alkylpolysaccharides as described in more detail in U.S. Pat. No. 4,565,647, specifically alkylpolyglycosides as described in more detail in U.S. Pat. Nos. 4,483,780 and 4,483,779; polyhydroxy fatty acid amides as described in more detail in U.S. Pat. No. 5,332,528, WO 92/06162, WO 93/19146, WO 93/19038, and WO 94/09099; ether capped poly(oxyalkylated) alcohol surfactants as described in more detail in U.S. Pat. No. 6,482,994 and WO 01/42408; and mixtures thereof.

The non-ionic detersive surfactant could be an alkyl polyglucoside and/or an alkyl alkoxylated alcohol. Preferably the non-ionic detersive surfactant is a linear or branched, substituted or unsubstituted $C_{8-18}$ alkyl ethoxylated alcohol having an average degree of ethoxylation of from 1 to 10, more preferably from 3 to 7.

Cellulosic polymer

The cellulosic polymer is typically a cellulose or a modified cellulose. Suitable cellulosic polymers include cellulose, cellulose ethers, cellulose esters, cellulose amides and mixtures thereof. Suitable cellulosic polymers include anionically modified cellulose, nonionically modified cellulose, cationically modified cellulose, zwitterionically modified cellulose, and mixtures thereof. Suitable cellulosic polymers include methyl cellulose, carboxy methyl cellulose, ethyl cellulose, hydroxyl ethyl cellulose, hydroxyl propyl methyl cellulose, ester carboxy methyl cellulose, and mixtures thereof.

Other suitable cellulosic polymers include cationic cellulose and derivatives thereof. Suitable cationic cellulose is available from Amerchol Corp. (Edison, N.J., USA) in their Polymer JR™ and LR™ series of polymers. Other suitable cationic cellulose is the form of a salt of hydroxyethyl cellulose that is reacted with trimethyl ammonium substituted epoxide, such as that supplied by Amerchol Corp. under the tradename Polyquaternium 10™. Another suitable type of cationic cellulose includes the polymeric quaternary ammonium salts of hydroxyethyl cellulose reacted with lauryl dimethyl ammonium-substituted epoxide, such as that supplied by Amerchol Corp. under the tradename Polyquaternium 24™. Suitable cellulosic polymers are supplied by Amerchol Corp. under the tradename Polymer LM-200™. Other suitable cellulosic polymers include: quaternary nitrogen-containing cellulose ethers, such as those described in more detail in U.S. Pat. No. 3,962,418; and copolymers of etherified cellulose and starch, such as those described in more detail in U.S. Pat. No. 3,958,581.

Most preferably, the cellulosic polymer is carboxy methyl cellulose, typically having the following general formula:

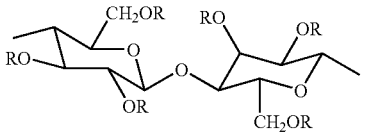

R = H or $CH_2COO^-$ and wherein at least one R moiety is $CH_2COO^-$.

Carbonate

The composition comprises carbonate. It may be preferred for the composition to comprise from 1 wt % to 50 wt %, or from 5 wt % to 25 wt % or from 10 wt % to 20 wt %, by weight of the composition, of carbonate. A preferred carbonate is a carbonate salt, typically sodium carbonate and/or sodium bicarbonate. A highly preferred carbonate is sodium carbonate. Preferably, the composition may comprise from 10 wt % to 20 wt % by weight of the composition, of sodium carbonate. However, it may also be preferred for the composition to comprise from 2 wt % to 8 wt % by weight of the composition, of sodium bicarbonate.

The carbonate, or at least part thereof, is typically in particulate form, typically having a weight average particle size in the range of from 200 to 500 micrometers. However, it may be preferred for the carbonate, or at least part thereof, to be in micronised particulate form, typically having a weight average particle size in the range of from 4 to 40 micrometers; this is especially preferred when the carbonate, or at least part thereof, is in the form of a co-particulate admixture with a detersive surfactant, such as an anionic detersive surfactant.

First particulate component

The first particulate component comprises: (i) a detersive surfactant; (ii) at least 10 wt %, preferably at least 12 wt %, or at least 15 wt %, or even at least 20 wt % by weight of the first particulate component, of carbonate; (iii) from 0 wt % to 10 wt %, preferably from 0 wt % to 8 wt %, or from 0 wt % to 6 wt %, or from 0 wt % to 4 wt %, or from 0 wt % to 2 wt %, or from 0 wt % to 1 wt % by weight of the first particulate component, of a zeolite builder; (iv) from 0 wt % to 10 wt %, preferably from 0 wt % to 8 wt %, or from 0 wt % to 6 wt %, or from 0 wt % to 4 wt %, or from 0 wt % to 2 wt %, or from 0 wt % to 1 wt % by weight of the first particulate component, of a phosphate builder; and (v) from 0 wt % to less than 5 wt %, preferably from 0 wt % to 4 wt %, or from 0 wt % to 3 wt %, or from 0 wt % to 2 wt %, or from 0 wt % to 1 wt %, or from 0 wt % to 0.1 wt. % by weight of the first particulate component, of a cellulosic polymer. Typically, the first particulate component comprises one or more adjunct components; the remaining portion, if any, of the first particulate component is typically made up of adjunct components.

However, preferably the first particulate component is substantially free of cellulosic polymer. By substantially free of cellulosic polymer it is typically meant that the first particulate component comprises no deliberately added cellulosic polymer.

Preferably, the first particulate component is substantially free of zeolite builder. By substantially free of zeolite builder it is typically meant that the first particulate component comprises no deliberately added zeolite builder.

Preferably, the first particulate component is substantially free of phosphate builder. By substantially free of phosphate builder it is typically meant that the first particulate component comprises no deliberately added phosphate builder.

Preferably, the first particulate component comprises a detersive surfactant, more preferably an anionic detersive surfactant. Preferably, the first particulate component comprises from 4 wt % to 60 wt %, more preferably from 6 wt %, or from 8 wt %, or from 10 wt %, or from 12 wt %, and preferably to 55 wt %, or to 50 wt %, or to 45 wt %, or to 40 wt % by weight of the first particulate component, of an anionic detersive surfactant.

If the composition comprises sodium carbonate, then preferably the first particulate component comprises at least 2 wt %, or at least 5 wt %, or at least 10 wt %, or at least 15 wt %, or even at least 20 wt % by weight of the first particulate component, of sodium carbonate.

The first particulate component may be in any suitable particulate form, including spray-dried form and non-spray-dried form. Most preferably, the first particulate component is in spray-dried form. However, the first particulate component may be in the form of an agglomerate, extrudate, needle, noodle, flake, preferably in the form of an agglomerate.

Typically, the first particulate component has a particle size distribution such that it has a weight average particle size of from 250 micrometers to 850 micrometers, and wherein no more than 10 wt %, preferably no more than 5 wt %, of the first particulate component has a particle size of less than 210 micrometers, and wherein no more than 10 wt %, preferably no more than 5 wt %, of the first particulate component has a particle size greater than 1,180 micrometers.

Second particulate component

The second particulate component comprises: (i) at least 0.20 wt %, preferably at least 0.5 wt %, or at least 1 wt %, or at least 5 wt %, or at least 10 wt %, or at least 20 wt %, or at least 30 wt %, or at least 40 wt %, or at least 50 wt %, or at least 60 wt %, or at least 70 wt %, or at least 80 wt %, or even at least 90 wt % by weight of the second particulate component, of a cellulosic polymer; and (ii) from 0 wt % to less than 20 wt %, preferably from 0 wt % to 15 wt %, or from 0 wt % to 10 wt %, or from 0 wt % to 8 wt %, or from 0 wt % to 6 wt %, or from 0 wt % to 4 wt %, or from 0 wt % to 2 wt %, or from 0 wt % to 1 wt % by weight of the second particulate component, of carbonate. Preferably, the second particulate component is substantially free of carbonate. By substantially free of carbonate it is typically meant that the second particulate component comprises no deliberately added carbonate.

If the composition comprises sodium carbonate, then preferably the second particulate component comprises from 0 wt % to less than 20 wt %, preferably from 0 wt % to 15 wt %, or from 0 wt % to 10 wt %, or from 0 wt % to 8 wt %, or from 0 wt % to 6 wt %, or from 0 wt % to 4 wt %, or from 0 wt % to 2 wt %, or even from 0 wt % to 1 wt % by weight of the second particulate component, of sodium carbonate. Preferably, the second particulate component is substantially free of sodium carbonate. By substantially free of sodium carbonate it is typically meant that the second particulate component comprises no deliberately added sodium carbonate. Typically, the second particulate component comprises one or more adjunct components; the remaining portion, if any, of the second particulate component is typically made up of adjunct components.

Preferably, the second particulate component is substantially free of zeolite builder. By substantially free of zeolite builder it is typically meant that the second particulate component comprises no deliberately added zeolite builder.

Preferably, the second particulate component is substantially free of phosphate builder. By substantially free of phosphate builder it is typically meant that the second particulate component comprises no deliberately added phosphate builder.

The second particulate component may be in any suitable particulate form, including spray-dried form and non-spray-dried form, preferably non-spray-dried form. Preferably, the second particulate component is in the form of an agglomerate, extrudate, needle, noodle, flake, preferably an agglomerate.

Typically, the second particulate component has a particle size distribution such that it has a weight average particle size of from 250 micrometers to 850 micrometers, and wherein no more than 10 wt %, preferably no more than 5 wt %, of the second particulate component has a particle size of less than 210 micrometers, and wherein no more than 10 wt %, preferably no more than 5 wt %, of the second particulate component has a particle size greater than 1,180 micrometers.

Solid laundry detergent composition

The composition is in free-flowing particulate form; this means that the composition is in the form of separate discrete particles; separate particles typically means that the particles in the composition are individual units of particulate matter that are physically distinct from one another. The composition can be in any free-flowing particulate form, such as in the form of an agglomerate, a spray-dried power, an extrudate, a flake, a needle, a noodle, a bead, or any combination thereof.

The detergent composition typically has a bulk density of from 450 g/l to 1,000 g/l, preferred low bulk density detergent compositions have a bulk density of from 550 g/l to 650 g/l and preferred high bulk density detergent compositions have a bulk density of from 750 g/l to 900 g/l.

During the laundering process, the composition is typically contacted with water to give a wash liquor having a pH of from above 7 to less than 13, preferably from above 7 to less than 10.5. This is the optimal pH to provide good cleaning whilst also ensuring a good fabric care profile.

The composition may be made by any suitable method including agglomeration, spray-drying, extrusion, mixing, dry-mixing, liquid spray-on, roller compaction, spheronisation or any combination thereof.

The weight ratio of the first particulate component to the second particulate component is in the range of from 1:1 to 1,000:1, preferably from 5:1, or from 10:1, or from 15:1, or from 20:1, or from 25:1, or from 30:1, or from 40:1, or from 50:1, or from 60:1, and preferably to 900:1, or to 800:1, or to 700:1, or to 600:1.

The composition comprises from 0 wt % to 10 wt %, preferably to 8 wt %, or to 6 wt %, or to 4 wt %, or to 2 wt %, or even to 1 wt % zeolite builder. Preferably, the composition is substantially free of zeolite builder. By substantially free of zeolite builder, it is typically meant that no zeolite builder is deliberately incorporated into the composition. Typical zeolite builders are zeolite A, zeolite P and zeolite MAP.

The composition comprises from 0 wt % to 10 wt %, preferably to 8 wt %, or to 6 wt %, or to 4 wt %, or to 2 wt %, or even to 1 wt % phosphate builder. Preferably, the composition is substantially free of phosphate builder. By substantially free of phosphate builder, it is typically meant that no phosphate builder is deliberately incorporated into the composition. A typical phosphate builder is sodium tri-polyphosphate.

Adjunct components

The composition typically comprises one or more adjunct components. These adjunct components include: bleach such as percarbonate and/or perborate, preferably in combination with a bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; chelants such as diethylene triamine pentaacetate, diethylene triamine penta(methyl phosphonic acid), ethylene diamine-N'N'-disuccinic acid, ethylene diamine tetraacetate, ethylene diamine tetra(methylene phosphonic acid) and hydroxyethane di(methylene phosphonic acid); enzymes such as amylases, carbohydrases, cellulases, laccases, lipases, oxidases, peroxidases, proteases, pectate lyases and mannanases; suds suppressing systems such as silicone based suds suppressors; photobleach; filler salts; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as oligomers produced by the condensation of imidazole and epichlorhydrin; flouresecent whitening agents; soil dispersants and soil anti-redeposition aids such as polymeric carboxylates, alkoxylated polyamines including ethoxylated ethyleneirine polymers; anti-redeposition components such as polyesters; perfumes; and dyes.

EXAMPLES

A particulate laundry detergent composition and process of making it.

Aqueous slurry composition.

| Component | % w/w Aqueous slurry |
|---|---|
| A compound having the following general structure: bis($(C_2H_5O)(C_2H_4O)n)(CH_3)$—$N^+$—$C_xH_{2x}$—$N^+$—$(CH_3)$-bis($(C_2H_5O)(C_2H_4O)n$), wherein n = from 20 to 30, and x = from 3 to 8, or sulphated or sulphonated variants thereof | 1.23 |
| Ethylenediamine disuccinic acid | 0.35 |
| Magnesium sulphate | 0.72 |
| Acrylate/maleate copolymer | 6.41 |
| Linear alkyl benzene sulphonate | 12.18 |
| Hydroxyethane di(methylene phosphonic acid) | 0.32 |
| Sodium carbonate | 12.87 |
| Sodium sulphate | 38.60 |
| Soap | 0.78 |
| Water | 26.13 |
| Miscellaneous | 0.41 |
| Total Parts | 100.00 |

Preparation of a spray-dried powder.

An aqueous slurry having the composition as described above is prepared having a moisture content of 26.13%. The aqueous slurry is heated to 72° C. and pumped under high pressure (from $5.5\times10^6 Nm^{-2}$ to $6.0\times10^6 Nm^{-2}$), into a counter current spray-drying tower with an air inlet temperature of from 270° C. to 300° C. The aqueous slurry is atomised and the atomised slurry is dried to produce a solid mixture, which is then cooled and sieved to remove oversize material (>1.8 mm) to form a spray-dried powder, which is free-flowing. Fine material (<0.15 mm) is elutriated with the exhaust the exhaust air in the spray-drying tower and collected in a post tower containment system. The spray-dried powder has a moisture content of 1.0 wt %, a bulk density of 420 g/l and a particle size distribution such that 95.2 wt % of the spray-dried powder has a particle size of from 150 to 710 micrometers. The composition of the spray-dried powder is given below.

Spray-dried powder composition.

| Component | % w/w Spray-dried powder |
|---|---|
| A compound having the following general structure: bis($(C_2H_5O)(C_2H_4O)n)(CH_3)$—$N^+$—$C_xH_{2x}$—$N^+$—$(CH_3)$-bis($(C_2H_5O)(C_2H_4O)n$), wherein n = from 20 to 30, and x = from 3 to 8, or sulphated or sulphonated variants thereof | 1.65 |
| Ethylenediamine disuccinic acid | 0.47 |
| Magnesium sulphate | 0.96 |
| Acrylate/maleate copolymer | 8.59 |
| Linear alkyl benzene sulphonate | 16.33 |
| Hydroxyethane di(methylene phosphonic acid) | 0.43 |
| Sodium carbonate | 17.25 |
| Sodium sulphate | 51.76 |
| Soap | 1.04 |
| Water | 1.00 |
| Miscellaneous | 0.52 |
| Total Parts | 100.00 |

Preparation of an anionic surfactant particle

The anionic detersive surfactant particle is made on a 554 g batch basis using a Tilt-A-Pin then Tilt-A-Plow mixer (both made by Processall). 85 g sodium sulphate supplied is added to the Tilt-A-Pin mixer along with 273 g sodium carbonate. 196 g of 70 % active $C_{25}E_3S$ paste (sodium ethoxy sulphate based on $C_{12}/_{15}$ alcohol and ethylene oxide) is added to the Tilt-A-Pin mixer. The components are then mixed at 1200 rpm for 10 seconds. The resulting powder is then transferred into a Tilt-A-Plow mixer and mixed at 200 rpm for 2 minutes to form particles. The particles are then dried in a fluid bed dryer at a rate of 2500 l/min at 120° C. until the equilibrium relative humidity of the particles is less than 15%. The dried particles are then sieved and the fraction through 1180 μm and on 250 μm is retained. The composition of the anionic detersive surfactant particle is as follows:

25.0% w/w $C_{25}E_3S$ sodium ethoxy sulphate
17.0% w/w sodium sulphate
54.57% w/w sodium carbonate
3.43% w/w water Preparation of a cationic detersive surfactant particle The cationic surfactant particle is made on a 17 kg batch basis on a Morton FM-50 Loedige mixer. 5.1 kg of sodium sulphate and 5.1 kg micronised sodium carbonate are pre-mixed in the Morton FM-50 Loedige mixer. 5.8 kg of 50% active mono-$C_8$-$C_{10}$ alkyl, mono-hydroxyethyl, di-methyl, ammonium chloride (cationic detersive surfactant) aqueous solution is added to the Morton FM-50 Loedige mixer whilst both the main drive and the chopper are operating. After approximately two minutes of mixing, a 1.0 kg 1:1 weight ratio mix of micronised sodium sulphate and micronised sodium carbonate is added to the mixer. The resulting agglomerate is collected and dried using a fluid bed dryer on a basis of 2500 l/min air at 100-140° C. for 30 minutes. The resulting powder is sieved and the fraction through 1400 μm is collected as the cationic detersive surfactant particle. The composition of the cationic detersive surfactant particle is as follows:

20 % w/w mono-$C_8$-$C_{10}$ alkyl, mono-hydroxyethyl, di-methyl, ammonium chloride 38.5 % w/w sodium carbonate 38.5 % w/w sodium sulphate 3.0 % w/w moisture and miscellaneous Preparation of a granular laundry detergent composition 10.87 kg of the spray-dried powder described above, 4.76 kg of the anionic detersive surfactant particle described above, 1.18 kg of the cationic detersive surfactant particle described above and 8.19 kg (total amount) of other individually dosed dry-added material, including carboxyl methyl cellulose, are dosed into a 1 m diameter concrete batch mixer operating at 24 rpm. Once all of the materials are dosed into the mixer, the mixture is mixed for 5 minutes to form a granular laundry detergent composition. The formulation of the granular laundry detergent composition is described below:

A granular laundry detergent composition.

| Component | % w/w granular laundry detergent composition |
|---|---|
| Spray-dried powder | 43.47 |
| Citric acid | 5.00 |
| Sodium percarbonate (having from 12% to 15% active AvOx) | 13.26 |
| Photobleach particle | 0.01 |
| Lipase (11.00 mg active/g) | 0.70 |
| Amylase (21.55 mg active/g) | 0.33 |
| Protease (56.00 mg active/g) | 0.43 |
| Tetraacetyl ethylene diamine agglomerate (92 wt % active) | 3.95 |
| Suds suppressor agglomerate (11.5 wt % active) | 0.87 |
| Green/blue carbonate speckle | 0.50 |
| Anionic detersive surfactant particle | 19.04 |
| Cationic detersive surfactant particle | 4.70 |
| Carboxy methyl cellulose | 1.43 |
| Sodium sulphate | 5.51 |
| Fluorescent whitening agent | 0.17 |
| Solid perfume particle | 0.63 |
| Total Parts | 100.00 |

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A solid laundry detergent composition comprising:

(a) a detersive surfactant;

(b) from 0 wt % to 10 wt % zeolite builder;

(c) from 0 wt % to 10 wt % phosphate builder;

(d) carbonate; and (e) a cellulosic polymer;

wherein the composition is in free-flowing particulate form and comprises at least two separate particulate components, wherein the first particulate component comprises:

(i) an anionic detersive surfactant;

(ii) at least 10 wt %, by weight of the first particulate component, of carbonate;

(iii) from 0 wt % to 10 wt %, by weight of the first particulate component, of zeolite builder;

(iv) from 0 wt % to 10 wt %, by weight of the first particulate component, of phosphate builder; and (v) from 0 wt % to less than 5 wt%, by weight of the first particulate component, of cellulosic polymer; and wherein the second particulate component comprises:

(i) at least 0.20 wt %, by weight of the second particulate component, of cellulosic polymer; and (ii) from 0 wt % to less than 20 wt %, by weight of the second particulate component, of carbonate; and a cationic detersive surfactant particle consisting of:

20 wt % mono-$C_8$-$C_{10}$ alkyl, mono-hydroxyethyl, di-methyl ammonium chloride, 38.5 wt % sodium carbonate, 38.5 wt % sodium sulphate, 3.0 wt % moisture and miscellaneous; and wherein the first particulate component has a particle size distribution such that it has a weight average particle size of from 250 micrometers to 850 micrometers, and wherein no more than 10 wt % of the first particulate component has a particle size of less than 210 micrometers, and wherein no more than 10 wt % of the first particulate component has a particle size greater than 1,180 micrometers, and wherein the second particulate component has a particle size distribution such that it has a weight average particle size of from 250 micrometers to 850 micrometers, and wherein no more than 10 wt % of the second particulate component has a particle size of less than 210 micrometers, and wherein no more than 10 wt % of the second particulate component has a particle size greater than 1,180 micrometers.

2. A composition according to claim 1, wherein the first particulate component is substantially free of cellulosic polymer.

3. A composition according to claim 1, wherein the first particulate component is substantially free of zeolite builder and phosphate builder.

4. A composition according to claim 1, wherein the first particulate component comprises anionic detersive surfactant.

5. A composition according to claim 1, wherein the second particulate component is substantially free from carbonate.

6. A composition according to claim 1, wherein the second particulate component comprises at least 50 wt %, by weight of the second particulate component, of cellulosic polymer.

7. A composition according to claim 1, wherein the composition comprises sodium carbonate, wherein the first particulate component comprises at least 10 wt %, by weight of the first particulate component, of sodium carbonate, and wherein the second particulate component comprises from 0 wt % to 10 wt %, by weight of the second particulate component, of sodium carbonate.

8. A composition according to claim 1, wherein the weight ratio of the first particulate component to the second particulate component is in the range of from 60:1 to 600:1.

9. A composition according to claim 1, wherein the first particulate component is in spray-dried form, and wherein the second particulate component is in non-spray-dried form.

10. The composition according to claim 1, wherein said first particulate component further comprises nonionic detersive surfactants, cationic detersive surfactants, zwitterionic detersive surfactants, amphoteric detersive surfactants or mixtures thereof.

11. The composition according to claim 10, wherein said cationic detersive surfactant is selected from the group consisting of alkyl pyridinium compounds; alkyl quaternary ammonium compounds; alkyl quaternary phosphonium compounds; alkyl ternary sulphonium compounds; and mixtures thereof.

12. The composition according to claim 1, wherein the second particulate component comprises at least 90 wt % by weight of said cellulosic polymer.

13. The composition according to claim 1, wherein the second particulate component consists essentially of said cellulosic polymer.

* * * * *